US009677258B1

(12) United States Patent
Peay

(10) Patent No.: US 9,677,258 B1
(45) Date of Patent: Jun. 13, 2017

(54) SYSTEM FOR MOUNTING A SINK

(71) Applicant: Michael Peay, Brentwood, TN (US)

(72) Inventor: Michael Peay, Brentwood, TN (US)

( * ) Notice: Subject to any disclaimer, the term of this patent is extended or adjusted under 35 U.S.C. 154(b) by 0 days.

(21) Appl. No.: 13/691,790

(22) Filed: Dec. 1, 2012

Related U.S. Application Data

(63) Continuation-in-part of application No. 12/833,805, filed on Jul. 9, 2010, now Pat. No. 9,538,863.

(60) Provisional application No. 61/224,060, filed on Jul. 9, 2009.

(51) Int. Cl.
*A47B 96/06* (2006.01)
*E03C 1/33* (2006.01)

(52) U.S. Cl.
CPC ..... *E03C 1/335* (2013.01)

(58) Field of Classification Search
CPC ..... E03C 1/335; E03C 1/33
USPC ..... 248/220.22, 201, 200.1; 4/633
See application file for complete search history.

(56) References Cited

U.S. PATENT DOCUMENTS 653,986 A * 7/1900 Conderman ..... E03C 1/322 248/235
1,253,924 A * 1/1918 Barnet ..... A47B 96/061 248/241
2,670,919 A * 3/1954 Esoldi ..... F21V 21/02 248/217.2
2,962,252 A * 11/1960 Frank ..... H02G 3/126 174/63
3,104,087 A * 9/1963 Budnick ..... H02G 3/125 248/216.4
3,229,310 A * 1/1966 Ensch ..... E03C 1/33 4/616
3,365,732 A * 1/1968 Juergens ..... E03C 1/33 4/634
4,504,986 A * 3/1985 Vigh ..... E03C 1/335 4/633
4,613,995 A * 9/1986 Ricke ..... E03C 1/33 4/633
4,757,967 A * 7/1988 Delmore ..... E04B 2/7453 248/218.4
4,832,297 A * 5/1989 Carpenter ..... H02G 3/125 248/205.1
4,967,990 A * 11/1990 Rinderer ..... 248/205.1
5,114,105 A * 5/1992 Young ..... H02G 3/126 248/27.1
D342,938 S 1/1994 Cheatham
5,386,959 A * 2/1995 Laughlin ..... H02B 1/015 248/200.1
5,505,419 A * 4/1996 Gabrius ..... F21V 21/04 248/200.1
5,538,206 A * 7/1996 Sather ..... E03C 1/33 248/201
5,743,501 A * 4/1998 Rapp ..... E03C 1/33 248/200.1
5,842,240 A * 12/1998 Kato ..... E03C 1/33 24/306

(Continued)

FOREIGN PATENT DOCUMENTS

GB 521696 A 5/1940

*Primary Examiner* — Monica Millner
(74) *Attorney, Agent, or Firm* — Patterson Intellectual Property Law, P.C.; Ryan D. Levy

(57) ABSTRACT

A system for mounting a sink under a countertop including one or more flexible supports and anchors to secure a sink wherein sealant may not be required.

10 Claims, 13 Drawing Sheets

(56) References Cited

U.S. PATENT DOCUMENTS 5,903,936 A * 5/1999 Kato ..... E03C 1/33 4/631
6,068,084 A * 5/2000 Taormina ..... E04G 21/32 182/113
6,106,190 A * 8/2000 Nakamura ..... E02B 3/26 114/219
6,519,791 B2 * 2/2003 Randolph ..... E03C 1/021 4/695
6,685,153 B2 * 2/2004 Foreman ..... 248/313
6,967,284 B1 * 11/2005 Gretz ..... H02G 3/125 174/50
7,173,186 B1 * 2/2007 Hageman ..... H02G 3/125 174/57
7,429,021 B2 9/2008 Sather et al.
7,435,902 B2 * 10/2008 Thornton ..... G01R 11/04 174/38
7,521,631 B2 * 4/2009 Dinh ..... H02G 3/125 174/480
8,011,628 B1 * 9/2011 Suddeth ..... H01Q 1/12 248/200
8,070,110 B2 * 12/2011 Jones ..... E03C 1/33 248/200.1
8,166,618 B2 * 5/2012 Eriksson ..... E03C 1/33 24/302
8,403,289 B1 * 3/2013 Rinderer ..... A47H 1/10 174/480
2007/0181330 A1 8/2007 Dinh
2008/0068830 A1 3/2008 Sharma
2008/0087778 A1 * 4/2008 Sather ..... E03C 1/33 248/201
2008/0196158 A1 * 8/2008 Jones ..... E03C 1/32 4/643
2008/0237421 A1 10/2008 Szpotowski
2008/0313804 A1 * 12/2008 Osterroth ..... E03C 1/33 4/695
2009/0255846 A1 10/2009 Pires et al.
2010/0230563 A1 * 9/2010 Flynn ..... A47K 1/05 248/201
2010/0301175 A1 * 12/2010 Grayson ..... E03C 1/33 248/27.1

* cited by examiner

SYSTEM FOR MOUNTING A SINK

The present application is a continuation of and claims benefit of co-pending U.S. patent application Ser. No. 12/833,805 entitled System for Mounting a Sink, filed on Jul. 9, 2010 which claims priority to U.S. provisional patent application Ser. No. 61/224,060, entitled "System for Mounting a Sink" filed Jul. 9, 2009 which are hereby incorporated by reference.

The present invention relates to a system and method for mounting a sink, the sink being optionally mounted underneath a surface. In optional embodiments, the surface may include laminates, stone, composite, metals, alloys, concrete or any other type of countertop material that may be utilized.

In the field of home design there are a multitude of different countertops that may be utilized throughout rooms in a residence. One area in which a variety of countertops are often used is in both kitchen and bathroom designs. Often times, especially in the design of a kitchen, countertops are installed and supported by cabinets which may include one or more doors in the area there beneath.

The countertops usually range of from about 20 inches to about 30 inches from the front to the back which is typically adjacent to a wall and often are designed to slightly overhang standard kitchen base cabinets. In certain designs, the countertops may be cut away to allow for the installation of various amenities including stoves, ranges, cook tops and sinks.

Various types of materials have been used for forming countertops used within kitchens or bathrooms. Common materials include natural stones such as granite, lime stone, marble, gabbro and soap stone. Further materials may include wood and metals such as stainless steel and/or copper. Other types may include tile or crafted glass either with or without a base component. Alternatively, countertops may be comprised of synthetic materials such as phenolic resin, epoxy, tile, terrazzo, cast in place materials, acrylic plastic materials such as Corian®, Meganite™, avonite and Wilsonart® solid surface, polyester acrylic plastics such as Velstone, engineered stone, laminates such as Formica®, and Arborite as well as concrete.

In some instances users may chose to have a sink installed in a bottom mount or under mount design where the edge of the countertop material is exposed at the opening created for the sink. The sink may then be mounted below the material from below.

U.S. Pat. No. D520,612 discloses, for example, an ornamental design for a sink which may be under mounted to a countertop having hole cut corresponding to such sink design. Otherwise stated, under mount sinks exist below the countertop converse to self rimming sinks which sit within holes in the countertop where the rim of the sink forms a fairly close seal with the top surface of the countertop.

In certain instances, under mount sinks are installed with either an adhesive or a brace to maintain the sink positioned relative to the countertop. The adhesives may include glues, epoxies and other compounds which may affix the sink to the underside of the countertop. Generally, this may include the use of clamps to maintain the sink in the desired position with the drying time of adhesives varying dependent upon the type of adhesive used and the local environmental conditions.

An optional aspect of the present invention is to provide a system for mounting an under mount sink to a countertop within either a kitchen or bathroom or other area where a sink may be desired. Optionally, the system may address one or more disadvantages of the prior art.

Another optional aspect of the invention is to provide a system for mounting a sink to the underside of a countertop that is secure.

Yet another optional aspect of the invention is to provide a system for mounting a sink to the underside of a countertop that is economical to produce, and that is simple and reliable to use.

In accordance with the purpose of the invention, as embodied and broadly described herein, the invention includes a system for mounting a sink in either a kitchen or a bathroom or the like.

An optional embodiment of the system may include one or more flexible supports for supporting the sink beneath the opening cut within the countertop. The flexible support may include adjustment points or no adjustment points, and be of a variety of lengths widths and thicknesses. The system may further include one or more anchors for anchoring the flexible support in supporting the under mounted sink. The anchors may include attachments to the adjacent cabinet walls as well as tightening anchors for adjusting the tension on the flexible supports in removing slack. The tightening anchor may include a tightening element to engage the flexible support. The anchors may include one or more non-tightening anchors or one or more tightening anchors or a combination thereof.

Another optional aspect of the invention includes a system for mounting a sink under a countertop having at least two support rails, each support rail having a top surface, bottom surface and side surfaces which may engage anchors. In such optional aspects, one or more flexible supports may span between the rail brackets.

In yet further optional aspects of the invention the support rails may be formed of wood or alternatively may be formed of woods, plastics, metals or a combination thereof.

In yet further optional aspects of the invention the system for mounting a sink may also include a plurality of holes of various diameters within the support rails. Optionally the system may also include two nuts for use with one or more of the holes of the plurality of holes within the support rails of the system for mounting a sink.

In yet further optional aspects of the present invention the anchors may include one or more support holes sized for the support rails. More specifically, the support holes may optionally have a square shaped opening. Further optionally the anchors may have support holes with optionally an opening with a rounded bottom edge, the opening of which the end of a support rail may fit therewithin.

In yet further optional embodiments the system may include one or more caps having a bolt end indentation and at least one biting edge. Optionally the caps may include a bolt indentation and multiple biting edges with the top surface of the indentation below the top edges of the biting edges and a cap yet to be installed against a sink. Additionally in other optional arrangements of the caps the caps may include extended legs that extend at least partially down on each side of the side surfaces of the rail.

The flexible support may include a plurality of holes with the flexible support positioned between each support rail and beneath the bowls of a multi-bowl sink. In additional optional aspects the flexible support may be of metal, plastic or a combination thereof.

As used herein, the term "engage" means to interact with, interlock with, associate or communicate with.

Further as used herein, the term "tighten" means to compress, fasten, grip, secure, strain, stretch, taughten, tense, bind or constrict.

According to another optional aspect of the invention, a system for mounting a sink may include a combination of flexible supports and anchors. The anchors may include attachments to the adjacent walls, and anchors, including tightening anchors. The system may further include additional flexible supports and anchors for securing the sink. Other styles of anchors include loop anchors, support anchors, corner anchors and any other type of anchor design which may be used in attaching to a cabinet wall. The flexible supports may be configured to prevent movement of the sink from the underside of the countertop.

Thus, where the flexible support and anchors of an optional embodiment of the invention are utilized, the use of adhesive or rigid braces may be precluded. As such a safer sink mounting may result.

Yet another optional aspect of the invention may include a system for mounting a sink where the use of flexible supports and anchors provide securement of a sink underneath a countertop than the use of adhesive alone.

An additional optional aspect of the invention may include a system for mounting a sink where the use of one or more flexible supports, supports and flexible supports provide for less down time than with the use of an adhesive alone which requires some significant time to cure.

Another optional aspect of the invention may include a system wherein two flexible supports may be utilized in a criss-cross fashion in mounting the sink underneath the countertop. The flexible connectors may include a coupler between the flexible supports which may maintain a desired position of the flexible supports in supporting the sink.

An additional optional aspect of the invention may include a mounting system for a sink wherein the countertops include a type of material wherein drilling, screwing or attaching thereto may be undesirable. For example, many of the natural stones including granite, limestone, marble, soapstone, and gabbro require skill to drill into as the user risks cracking or undesirably deforming the countertop surface. Other countertop surfaces include stainless steel, glass as well as many of the synthetic countertop materials in which one would rather not drill a screw or bolt into in installing an undermount sink. Such drilling or screwing may result in cracking or otherwise undesirable changes to the countertop.

Another optional aspect of the invention may include a system wherein the anchors are connected to the cabinet walls or corners and engage supports attachment points for one or more flexible supports so that an under mounted sink is held close to a countertop for use. In yet further optional aspects of the invention a sealant may be utilized at a contact point between the sink and the countertop to as to preclude water from escaping between the contact area of the sink and the countertop.

The mounting system may preclude the reliance upon adhesive in securing an undermounted sink where clamps are typically utilized for extended periods of time in mounting a sink while the adhesive sets. As such, a plumber or other individual may begin work sooner as one optional aspect of the mounting system provides for mounting an undermounted sink both quickly and simply. The mounted sink, for example, may be completely mounted upon the use of the anchors and flexible support.

Yet another optional aspect of the invention may include a mounting system wherein one or more tightening anchors are utilized.

In an optional aspect the tightening anchor may include the use of pins, screws, rings or other mechanical devices to allow for the tightening and securing of the flexible support as described herewithin. Tightening anchors also include anchors in which slack may be removed from the flexible support with or without other mechanical devices which may set the tightening anchor so that further movement is precluded. As such, tightening anchors may include separate pins or other mechanical devices used in conjunction therewith for providing stability with the flexible supports.

The term "providing," and forms thereof are used in a broad sense and refers to, but are not limited to making available for use, enabling usage, giving, supplying, obtaining, getting a hold of, acquiring, making ready for use, and/or placing in a position ready for use.

The systems that have been described may be particularly useful for mounting a sink for example, in a kitchen or bathroom or other location where the sink is mounted under the countertop.

Aside from the structural and procedural arrangement set forth above, the invention could include a number of other arrangements, such as those explained hereinafter. It is to be understood, that both the foregoing description and the following description are exemplary.

The accompanying drawings are incorporated in and constitute a part of this specification. The drawings illustrate optional embodiments of the invention and together with the description, serve to explain some principles of the invention.

FIG. 1 comprises a prospective view of an optional embodiment of a system for mounting a sink.

Figure 6A:
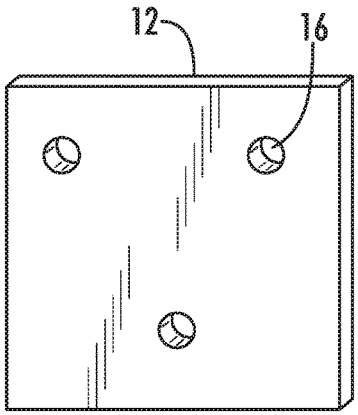
Figure 6B:
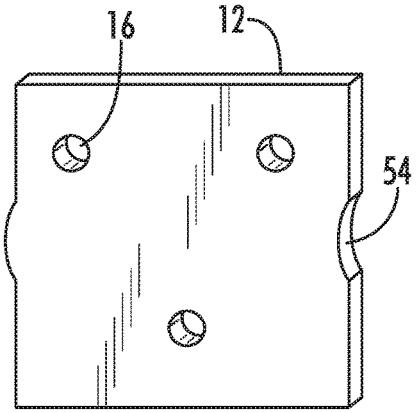

FIG. 6*a*-6*b* are illustrations of optional embodiments of anchors for a system for mounting a sink.

Figure 7A:
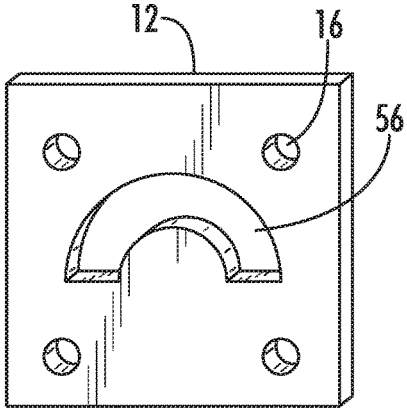
Figure 7B:
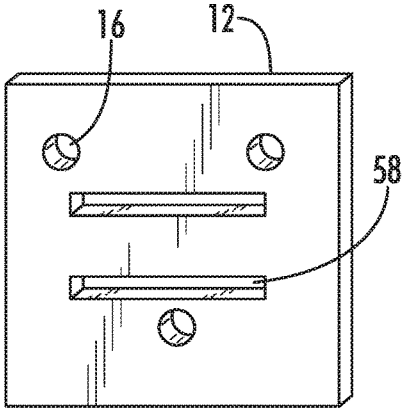

FIG. 7*a*-7*b* are optional embodiments of anchors for a system for mounting a sink.

Figure 8A:
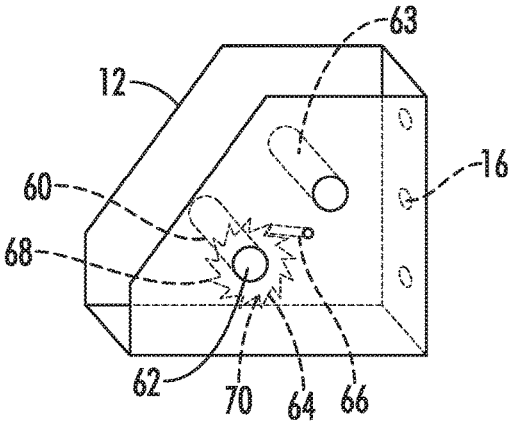
Figure 8B:
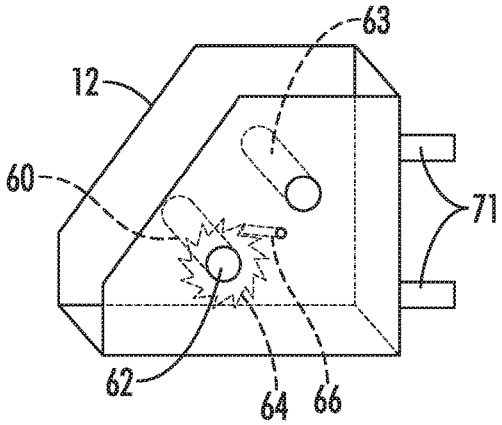

FIG. 8*a*-8*b* are optional embodiments of illustrations of tightening anchors for a system for mounting a sink.

FIG. 9*a*-*d* are views of an optional embodiment for a system for mounting a sink.

Figure 10:
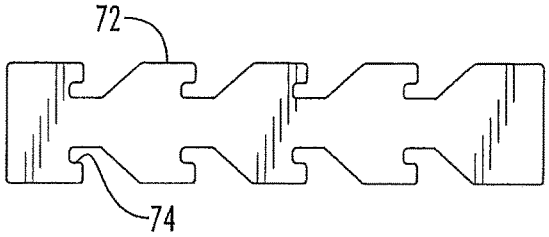

FIG. 10 is a view of an optional embodiment of an adjustment member for a system for mounting a sink.

Figure 11:
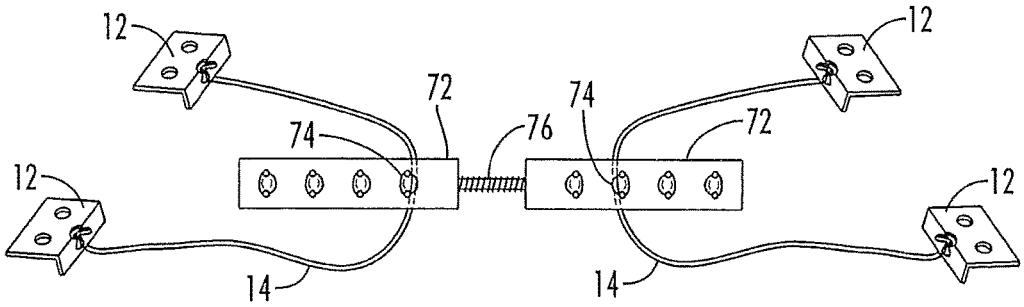
Figure 12:
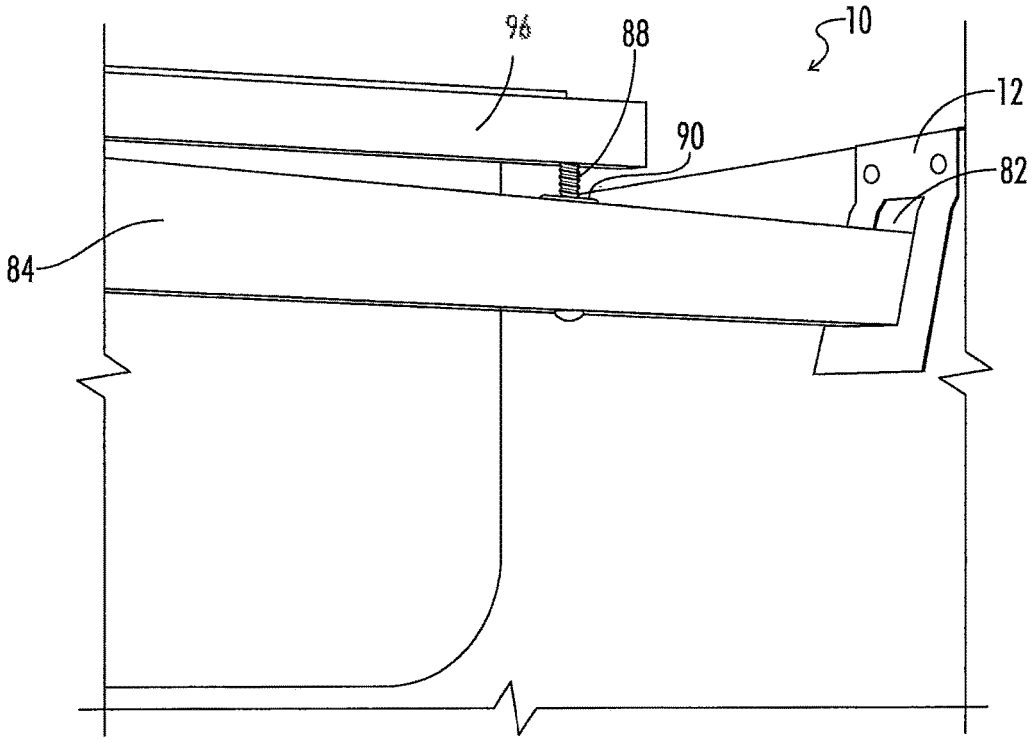

FIG. 11 is a view of an optional embodiment for a system for mounting a sink FIG. 12 is a view of an optional embodiment with support rails under a sink.

Figure 13:
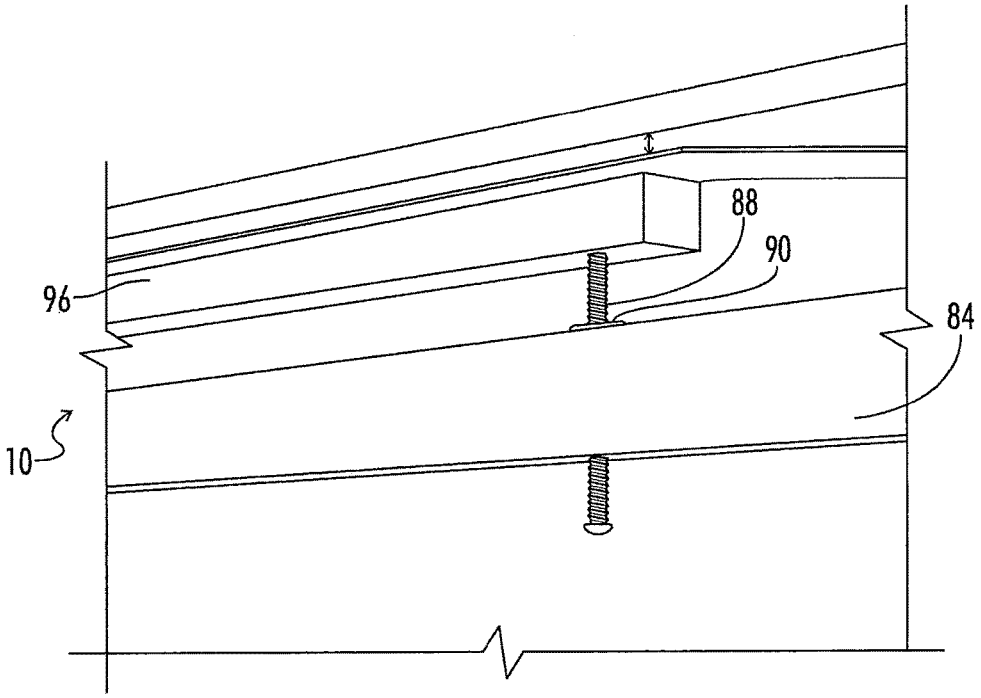

FIG. 13 is a view of an optional embodiment with support rails and secondary supports under a sink.

Figure 14:
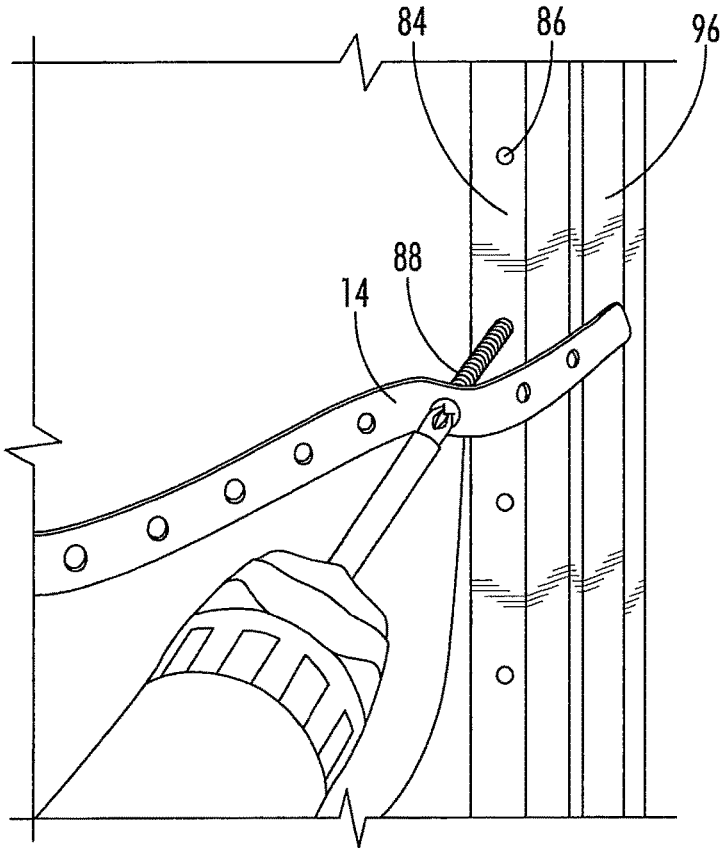

FIG. 14 is a view of an optional embodiment with support rails with the flexible support being connected.

Figure 15:
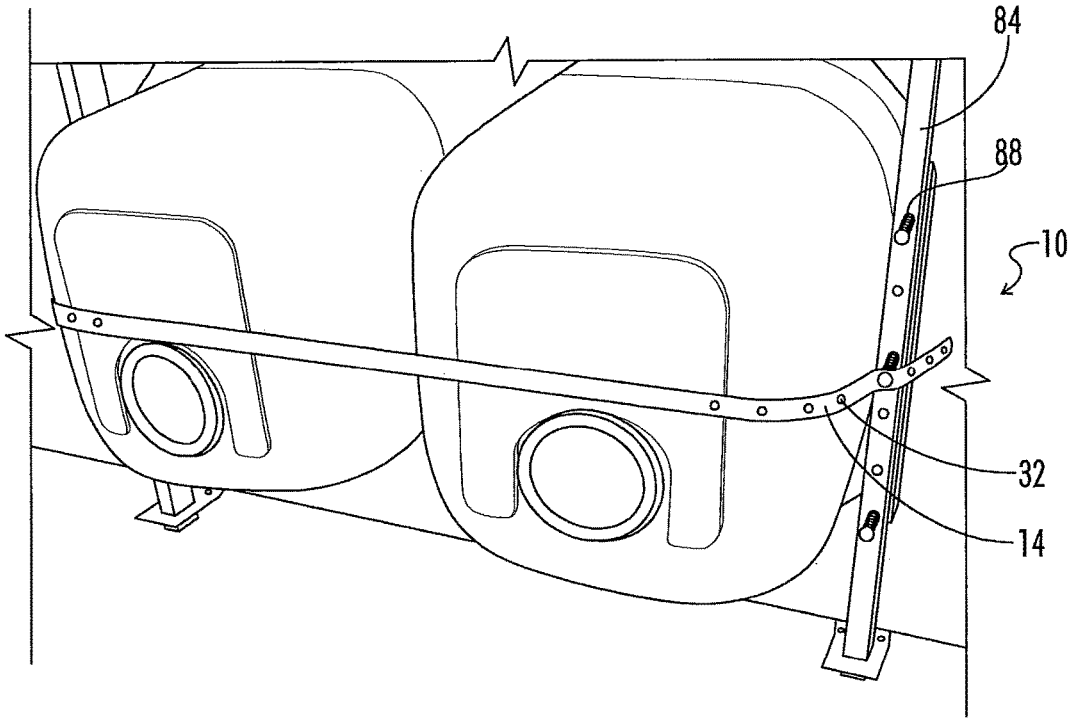

FIG. 15 is a view of an optional embodiment with support rails illustrating the flexible support under a multi-bowl sink.

Figure 16:
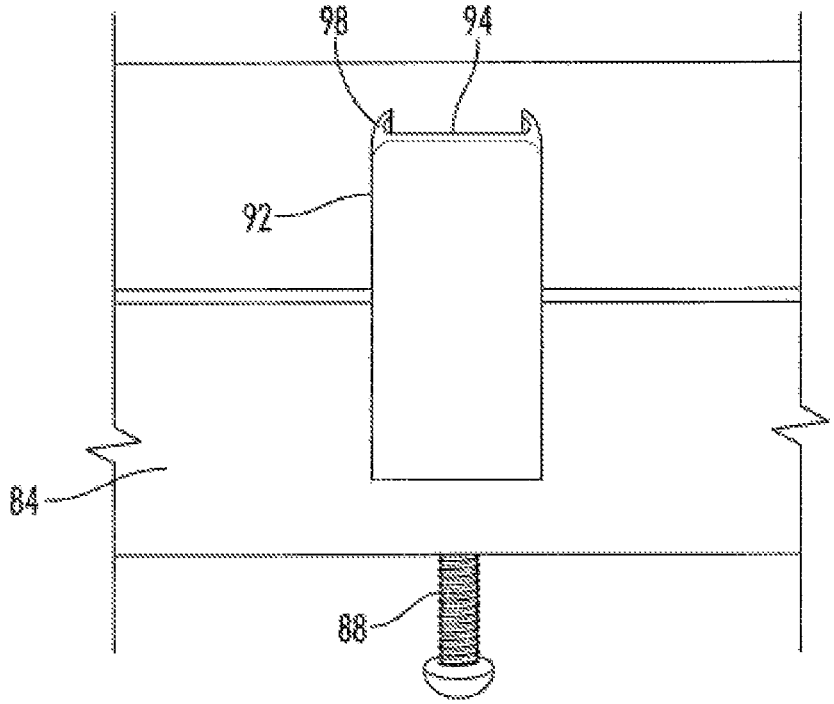

FIG. 16 is a view of an optional embodiment with support rails and a cap.

Figure 17:
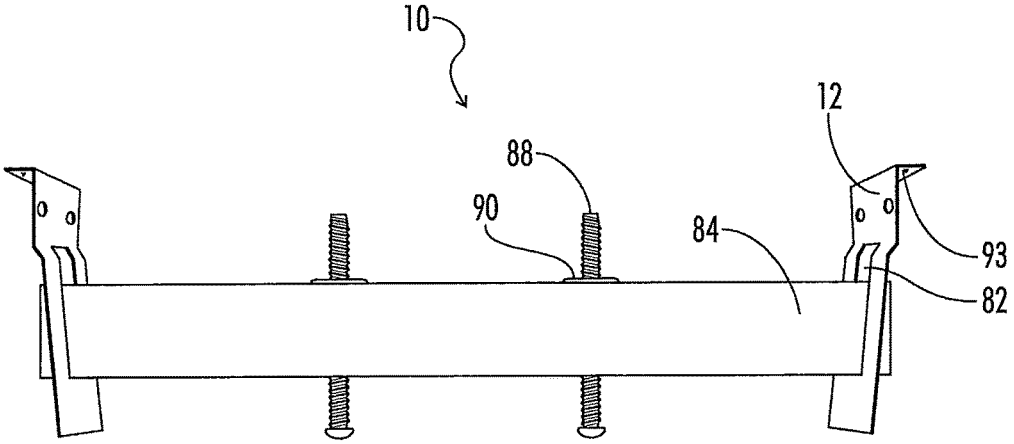

FIG. 17 is a view of an optional embodiment with support rails illustrating a support rail, threaded members, and anchors without cabinet walls or a sink.

Figure 18:
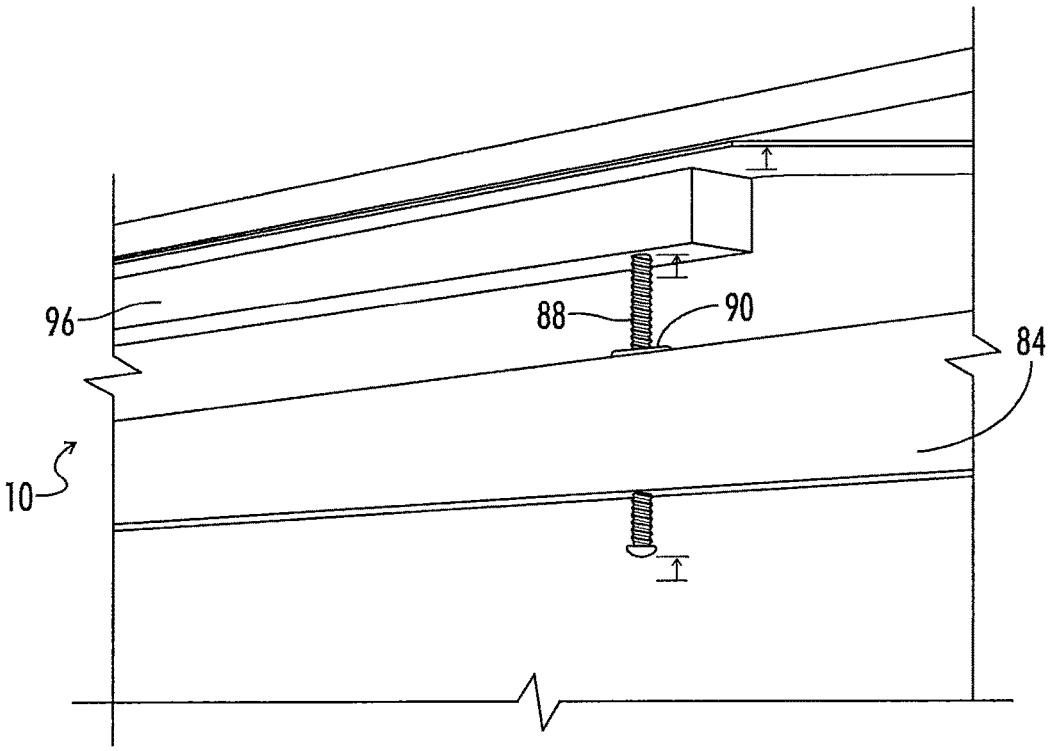

FIG. 18 is a view of an optional embodiment with support rails and secondary supports under a sink.

Reference will now be made in detail to optional embodiments of the invention, examples of which are illustrated in accompanying drawings. Whenever possible, the same reference numbers are used in the drawings and the description refer to the same or like parts.

Figure 1:
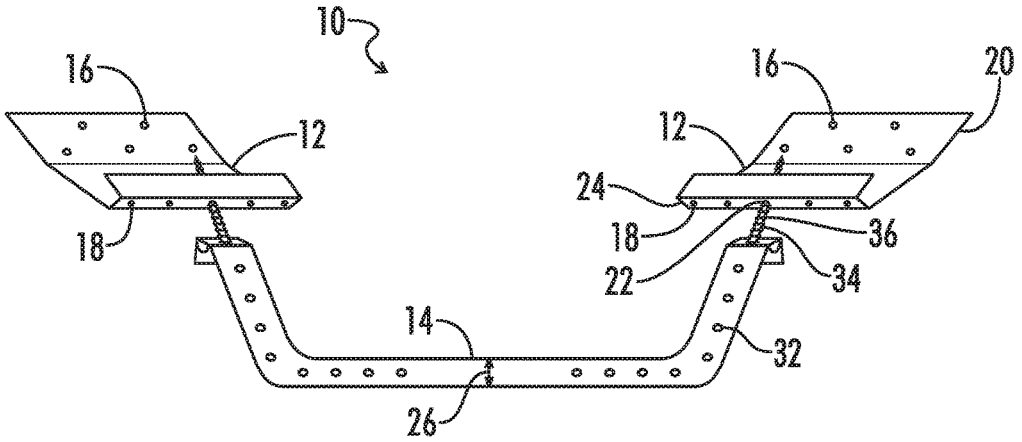

As shown in FIG. 1, system 10 may comprise anchors 12 and flexible support 14. For example, a portion of system 10 or the complete system 10 may include 2 anchors 12 and one flexible support or in further optional embodiments the system may include multiple anchors 12 and multiple flexible supports 14. The design and numbers of flexible supports and anchors may be decided by the individual installing the sink and as furthermore may be determined upon the size and type of sink for which will be mounted.

One optional embodiment of anchors 12 may comprise mounting holes 16, support attachment holes 18 for attaching to flexible support 14. The anchors may also comprise structure contact side 20 where anchors 12 contact structure beneath the sink. Generally the structure may comprise walls such as cabinet walls or in further embodiment may just include any type of support walls running generally about perpendicular to the ground for which anchors 12 may attach. Further embodiments may include embodiments where the mounting holes and the attachment holes are the same holes.

Figure 2:
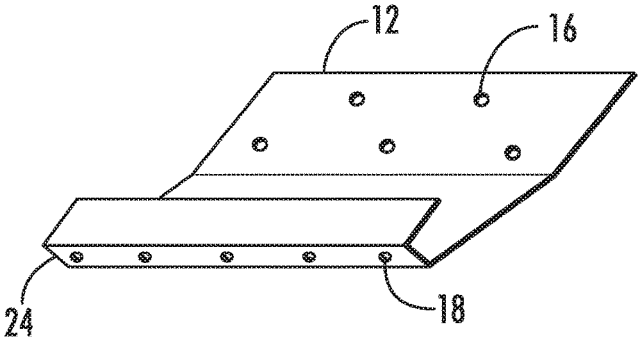
FIG. 2 is a view of an optional embodiment of an anchor for a mounting system for a sink.

Referring now to FIG. 2, an optional embodiment of anchor 12 may comprise a variety of different mounting hole 16 locations so as to provide a user with multiple possibilities in mounting the anchor as desired. As such, illustrations of anchor 12 should not be considered limiting in any regard as multiple hole locations including numbers, sizes, as well as quantity may exist for the present invention. Furthermore, sizes and shapes of the anchor may be different than as embodied as the optional embodiment provides merely one of the possible types of anchor 12 of the system. Additionally, support attachments 24 may be located in different quantities, sizes and locations and furthermore on different contours of anchor 12. In optional embodiments support attachment holes 18 may comprise threads 22 so that screws may be threaded there within. In further embodiments support attachment holes 18 may comprise no threads as a simple bolt and washer or other types of embodiments may be utilized in attaching flexible support 14 to the anchors as portrayed in this optional embodiment.

Anchor 12 may have a variety of different contours and shapes in attaching to adjacent walls as well as to flexible support 12 of the system. Such designs may include attachment portion 24 of anchor 12 including one or more support holes 18 which may or may not include threads 22. Attachment portion 24 may be angled from wall contact portion 20 so as to provide the user with greater ease in attaching one or more flexible supports 14 to anchor 12. In further embodiments attachment portion 24 may comprise a variety of shapes, contours and sizes in relation to the rest of anchor 12.

In yet further optional embodiments anchor 12 may comprise a variety of attachments for receiving and connecting to flexible support 14. This may include hooks and loops as well as holes for a variety of attachments from pins to nails to screws to clips and rings in providing a physical attachment for flexible support 14 and in optional multiple flexible supports 14.

Figure 3:
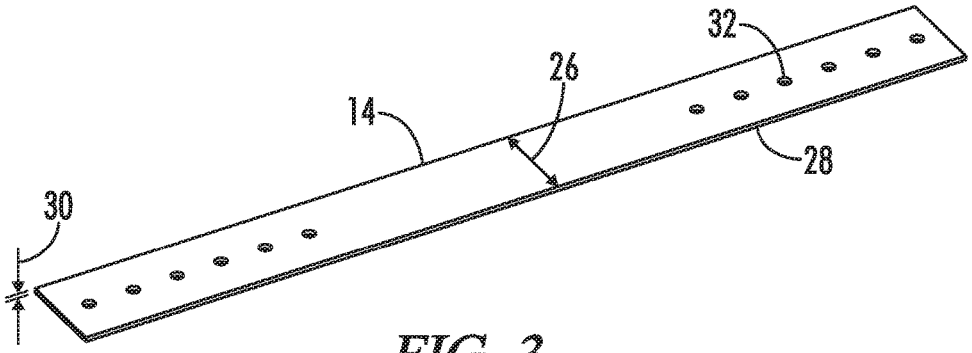
FIG. 3 is a view of an optional embodiment of a flexible support for an optional embodiment of a mounting system for a sink.

Referring now to FIG. 3 as shown is one optional embodiment of flexible support 14. Flexible support 14 may include a strap type design comprised of a multiplicity of different materials.

As used herein "flexible" means able to flex, able to bend, capable of being bent without breaking, pliable, not stiff, and/or not rigid.

Flexible supports 14 may comprise wire, cable, rope, straps as well as plastic straps, metal strapping, polymer straps, and combinations thereof. Flexible support 14 may have width 26 less than a length 28 with a thickness 30 less than width 26. In optional embodiments of flexible support 14, wire, cable or rope and even chain may be utilized. Flexible support 14 may also include flexible support holes 32 for mounting to anchors 12 of system 10.

In further optional embodiments, support holes 32 may be in lesser or greater quantities as well as have different sizes and shapes and in even further optional embodiments may not be included in flexible support 14. In such embodiments, support holes 32 may not be necessary for the system to function and furthermore in additional optional embodiments support holes 32 may be constructed by the user.

Figure 4:
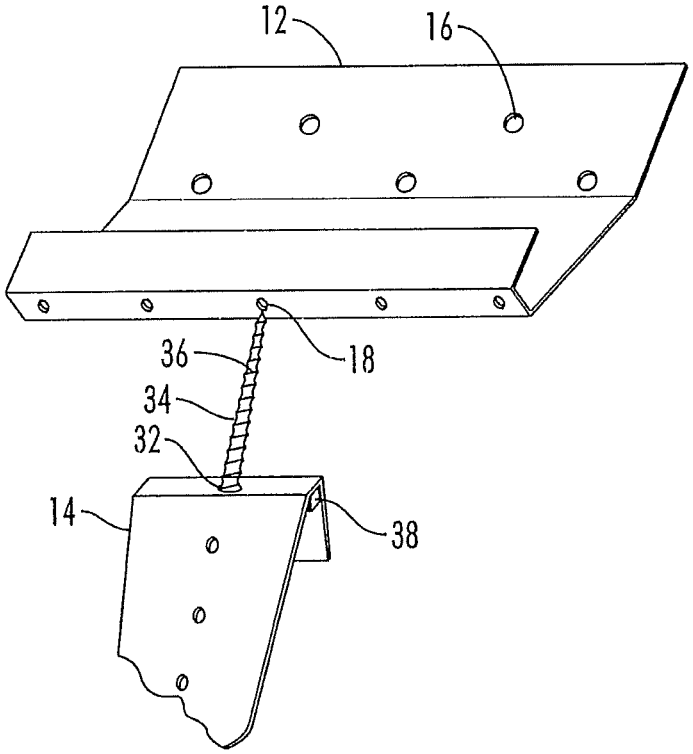
FIG. 4 is a view of an attachment of optional embodiments of the flexible support and anchor of a system for mounting a sink.

FIG. 4 illustrates an optional embodiment of anchor 12 with flexible support 14 of system 10. Connection 34 may be utilized to attach flexible support 14 to anchor 12 through one or more of support holes 32 of flexible support 14 to one or more support attachment holes 18 in anchor 12. Additionally, attachment 34 may include threads 36 so that in optional embodiments of support attachment holes 18 with threads 22 attachment 34 with threads 36 may thread there into.

In optional embodiments attachment 34 may include nuts, bolts, nails, washers or other types of hardware used in attaching and securing items so as to provide a secure connection between flexible support 14 and anchor 12 of mounting system 10. As such, one optional embodiment includes the use of rectangular washers 38 optionally at flexible support 14 or additionally at support attachment holes 18 of anchor 12 (not shown) which may spread some of the force created by the weight of the sink.

In further optional embodiments attachment 34 may include clips, pins and rings, nails, hooks, S-hooks, zip ties, nuts and bolts, rivets, and combinations thereof in attaching flexible support 14 to anchor 12 of system 10. An additional optional embodiment may include a pin with a hole therewith through which may be inserted within one or more support holes 32 and subsequently pass through support attachment holes 18 in positioning the flexible support to anchor 12 with a stop pin placed through the hole of the other pin in attaching the two portions of system 10 together. Additionally, optional embodiments may also include the use of a type of thread adhesive in further securing threaded components together in further minimizing the chances that threaded components may become unthreaded.

Figure 5:
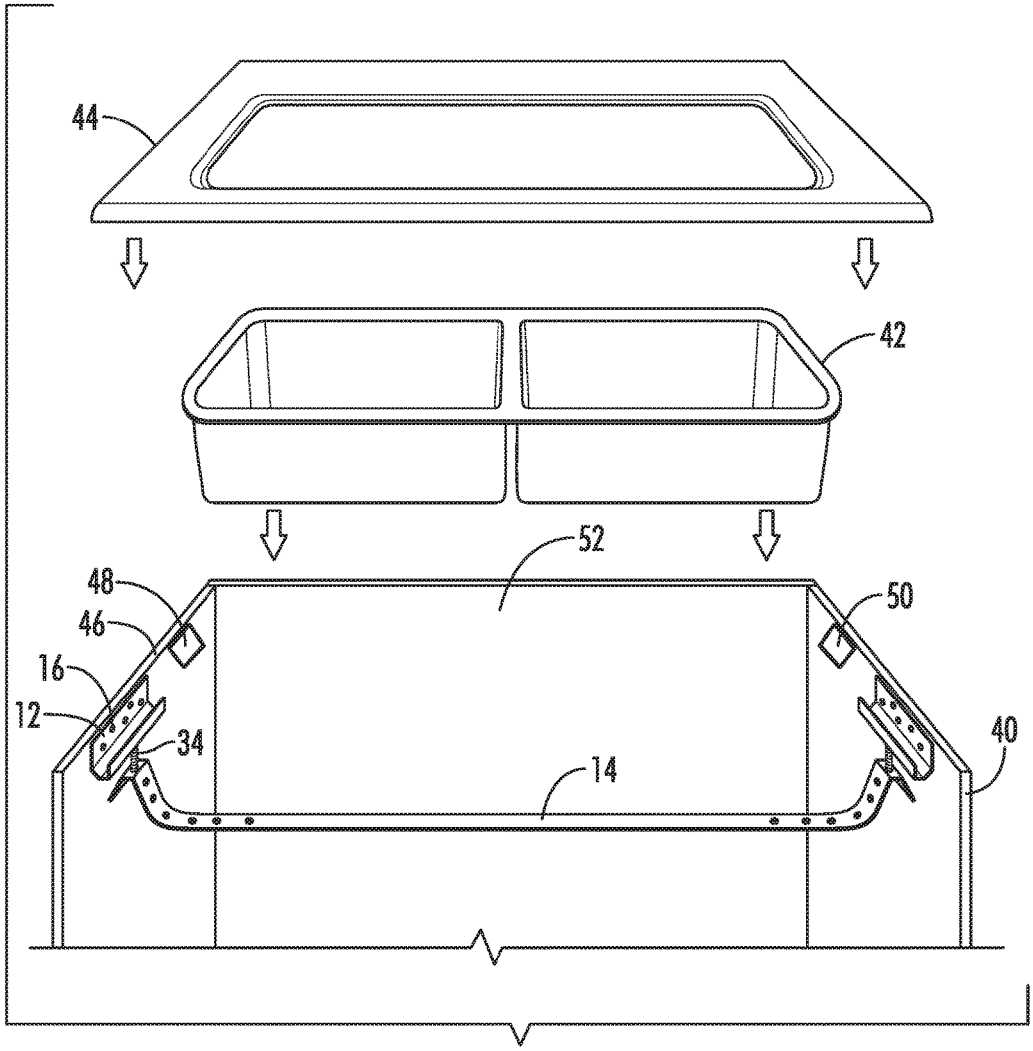
FIG. 5 is an exploded view of the system for mounting a sink with a sink and a countertop.

The system that has been described may be used as follows and is shown in FIG. 5. The user may mount anchors 12 to walls 40 and secure flexible support 14 between anchors 12. Sink 42 may then be placed on flexible support 14 with countertop 44 placed there above. In further embodiments countertop 44 may already rest upon cabinet edge 46 and in use of one optional embodiment of the system anchors may be installed to wall 40, sink 42 adjusted in the proper location and finally flexible supports 14 secured between anchors 12.

Additional embodiments may include the use of anchors at location 48 and 50 and further may be utilized along back wall 52 and even the front of the cabinetry (not shown). Other optional aspects of the invention may include flexible supports connecting from anchor 12.1 to an anchor at location 50 and an additional flexible support connecting to anchor 12.2 as well as to anchor 12 located at location 48. In review of the possible locations for the anchors in the use of flexible straps, multiple different orientations may be utilized in supporting the sink and the illustration of one optional embodiment should not be taken as limiting in any regard to the possible arrangements of the invention.

Referring now to FIGS. 6*a* and 6*b* the further embodiments of anchors of an optional embodiment of the system. In one optional embodiment as illustrated in FIG. 6*a*, anchor 12 may mount to a wall with flexible support 14 between anchor 12 and the wall. The holes in this optional embodiment of anchor 12 may comprise both holes 16 and support holes 32 and be used as either. In optional embodiments flexible support 14 may be mounted there through in attaching the anchor to the wall where a screw, nail, bolt or other devise may either pierce flexible support 14 or pass through holes within flexible support 14.

Referring now to FIG. 6*b*, there is an optional embodiment of anchors 12The having indention 54 for placement of flexible support 14. Further optional embodiments of indention 54 may comprise a variety of shapes, sizes and locations and provides for a location in which flexible support 14 may be positioned.

Referring now to FIG. 7*a*, there is an optional embodiment of anchor 12 including loop 56. In such embodiments flexible support 14 may pass above or below loop 56 and either terminate at loop 56 or pass about loop 56 to a different anchor. In such embodiments flexible support 14 may be attached at one anchor, pass through loop 56 on a different anchor an either reattach at the anchor in which flexible support 14 is attached or alternatively, attach to a different anchor. As such, multiple anchors 12, including loops 56 may be used with any other style of anchor in providing a point of attachment for flexible support and possibly positioning around loop 56.

In additional optional embodiments FIG. 7*b* illustrates anchor 12 having slits 58. Flexible support 14 may thread through one or more slits 58 of anchor 12 in attaching or looping at the anchor. In additional optional embodiments not illustrated, lesser or greater numbers of slits 58 may be utilized in forming the anchor. Furthermore, the term "slits" as used herein means any openings on the anchor through which the flexible support 14 may pass there into. There is no set method or order in which flexible support 14 may pass through one or more slits 58 in securing the system.

An optional embodiment of anchor 12 as shown in FIGS. 8*a* and 8*b* may also be in the form of a tightening anchor. The tightening anchor 12 as used in the present invention may include tightening element 60 for moving slack from a flexible support to which it is attached. Tightening element 60 may comprise a variety of different tightening elements including a ratcheting element or elements. As used herein, the term "ratcheting" means moving in one direction, having a toothed wheel or ratchet that engages with a pawl to prevent movement in one direction, allowing linear or rotary movement in one direction, or having a ratchet wheel.

Other optional embodiments of the tightening element comprise pins with attachments for a flexible support which may rotate as well as other rotatable and non-rotatable elements to take up slack in flexible support 14.

In one optional embodiment tightening element 60 may comprise a ratchet element which may be turned to provide tension to flexible support. This may comprise the use of engagement point 62 for the user to rotate a gear wheel portion of a ratchet in removing slack from a flexible support there connected with. In optional embodiments, flexible support 14 may first pass behind support bar 63 of anchor 12 and then either connect to tightening element 60 or pass through tightening element 60 to be subsequently tightened.

In optional embodiments including tightening element 60 as a ratchet, tightening element 60 may comprise gear wheel 64 and pawl 66 so that pawl 66 may slide up and over each tooth 68 of gear wheel 64 with the pawl 66 being forced back down into depression 70 between the teeth. In further embodiments not illustrated, tightening element 60 may comprise ratchets with multiple gear wheels at various locations on anchor 12 both internally and externally in providing a user the capacity to tighten a flexible support quickly and easily.

As previously mentioned, tightening element 60 may comprise a variety of different elements not illustrated herein. Such elements may comprise a bar with a slit for inserting a flexible support there through, a rotatable element with various screw, pin or nut and bolt type attachments for affixing with a flexible support as well as various fit screws, clamps and locks that may be utilized to pull flexible support 14 there through and remove slack in providing adequate support to a sink.

In further optional embodiments of anchor 12, either mounting hole 16 or mounting tab 71 may be utilized in affixing anchor 12 to a cabinet.

Components of anchor 12 may be comprised of a variety of materials including metals such as steel, iron, aluminum, alloys, other metals or combinations thereof as well as plastics, polymers and the like in providing suitable anchors for the present invention.

The system that has been described may also be used as described below. The user may first mount anchors 12 to walls 40 prior to placing a flexible support 14 between the anchors. As previously described, one or more anchors may be utilized and any discussion is not intended to limit the invention in any regard. Flexible support 14 may be used and attached between anchors 12 in providing a support for sink 42. Once sink 42 is placed upon flexible supports 14 the countertop may be placed or optionally in embodiments where the countertop is already affixed, the portions of flexible support between the anchors may be sized so as to provide support to push sink 42 against counter 44. This may comprise the use of one or more anchors having tightening element 60 where the user may tighten the flexible support, optionally by manipulating engagement 62 in removing slack from flexible supports 20.

Referring now to FIGS. 9*a*-9*d* there is provided an additional optional embodiment of a system for mounting a sink. In such optional embodiments, flexible support coupler 72 may be utilized to connect with flexible support 14 which may optionally be attached to anchors 12. In embodiments as illustrated, flexible support coupler 72 may include adjustment points 74 in providing the user options in sizing the system for mounting a sink. In further embodiments as illustrated in FIG. 10, flexible support coupler 72 may include a variety of shapes and sizes for adjustment 74 including notches, hooks, indentations, twists, tabs or the like for securing flexible support 14 at various adjustment points 74. In further embodiments not illustrated, flexible support coupler 72 may include only one point of connection to flexible support 14 or furthermore may include greater or lesser numbers of adjustment points than as illustrated in the provided drawings.

Optional embodiments of the system of the present invention may also include adjuster 76 which may span through adjuster holes 78 within two flexible support couplers 72. Generally adjuster baffles 80 may be included on sides of adjuster holes 78. Baffles 80 as used herein are defined as any sized item which may be utilized to maintain adjuster 76 between two flexible support couplers 72 and can comprise washers, rectangular washers, tabs, threaded items and the like. One or more adjustment holes 78 may be threaded so that baffles 80 may not be required in connecting two flexible support couplers 72 together.

Figure 9A:
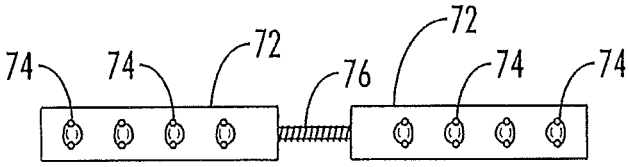
Figure 9B:
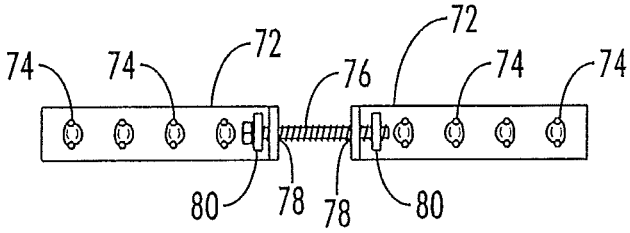
Figure 9C:
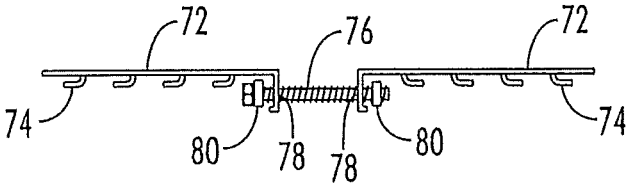
Figure 9D:
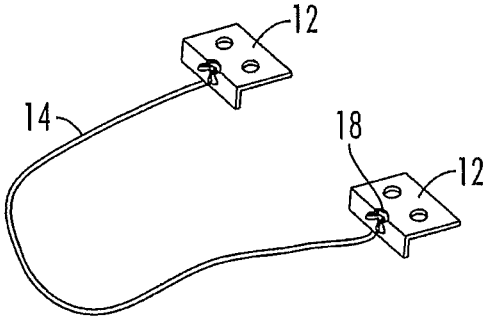

Anchors 12 as disclosed in FIG. 9*b* may additionally comprise one or more support attachment holes 18 so that a flexible support may pass therethrough and be twisted for securing to the anchor. In further optional embodiments, anchors as previously provided may be utilized with flexible support and in combination with flexible support couplers for practice of the present invention.

Referring now to FIG. 11, there is a general illustration of the configuration of an optional embodiment of the system without a sink or cabinet walls. Generally one flexible support 14 may be attached between two anchors 12 and connected at attachment holes 18 for attaching a flexible support to anchors. The invention may comprise two flexible supports and two sets of anchors so that each flexible support may be connected between two anchors. Each of flexible supports 14 may be bent in either a bowed shape, U shape or V shape and connected to a flexible support coupler 72. Flexible support coupler 72 may be connected by one or more adjusters 76 with a flexible support connected at each flexible support coupler 72 for supporting a sink. In optional embodiments, anchors 12 are attached to a cabinet wall with both flexible support couplers and adjuster 76 spanning between the flexible supports and anchors. A user may select the appropriate adjustment point 74 for the desired sink so that proper support is provided to an undermounted sink. Optionally a user may manipulate adjuster 76 to move flexible support coupler 72 further or closer together so as to provide for greater or lesser tension upon a bottom of a sink. The use of the flexible supports together with couplers and at least one adjuster generally provides a system that has a harness-like characteristic in positioning an undermounted sink against the countertop.

Advantageously a user has multiple sizing options in providing for a system to mount a sink. With multiple adjustments on a flexible support coupler along with an adjuster between flexible support couplers, a user may remove or add anywhere from about two inches to about eighteen inches of length for the system so that desired tension can be provided to an undermounted sink. By changing the slack in the system of the present invention, greater or lesser tension may be applied to a sink in holding the sink against the underside of a countertop. Additionally, the optional embodiment of one or more adjustment points 74 combined with adjuster 76 between flexible support couplers 72 provides for both large and small adjustments in the system so that tension can be readily tailored to the specific sink mounted underneath a countertop. A user can make larger incremental changes in slack in the system by moving the flexible support from one adjustment point to another, which may generally be from about 0.20 inches to about 2 inches apart. Furthermore, by rotating the adjuster, the ends of each flexible support coupler having adjuster hole 78 are drawn nearer together or pushed farther apart.

As illustrated in FIGS. 12-17, an optional embodiment of system 10 my include anchors 12 with support holes 82 which may support support rails 84. Generally, flexible support 14 may span from one support rail 84 to the other support rail 84.

Anchors 12 with support holes 82 may be of a variety of shapes. In some such embodiments, the support holes 82 may have a rectangular shape, though in other embodiments, the support holes 82 may have a circular or oval shape. Support holes 82 are designed with a great enough size so that an end of a support rail 84 may fit there within. In some optional embodiments, support hole 82 may correspond to the cross-section of the end of the support rail 84, though in other optional embodiments, support hole 82 may have an opening that does not correspond to the cross-sectional shape of the end of a support rail 84. Depending on the composition of support rail 84, support hole 82 may partially dig into support rail 84. Optionally, a circular support hole 82 may engage a rectangular or polygonal cross-sectional shaped support rail and possibly bite or indent into the corners of support rail 84. Furthermore, anchors 12 may include one or more stabilizing points 93 that may be used to help stabilize the relationship of the anchor 12 with a cabinet wall. Otherwise stated, stabilizing points 93 may partially puncture the top edge of the cabinet wall and help maintain anchor 12 in position either prior to or instead of mounting anchors 12. Additionally, as discussed previously, anchors 12 may also include mounting holes 16.

Support rails 84 may be formed of a variety of materials, ranging from wood, metal, plastic, and combinations thereof, including coated wood and the like. Generally, support rails 84 span just slightly less than the distance between the walls of the cabinet. In many optional embodiments, this is understood to mean the back wall of the cabinet to the front of the cabinet, where a door may be. However in optional embodiments, support rails may span from one sidewall to the opposite sidewall. Furthermore, in instances where a different length may be desired, a user may cut support rails 84 to the proper length.

Support rails 84 may include support rail holes 86 spanning from the topside to the bottom side of each support rail 84. Threaded members 88 may fit within one or more of support rail holes 86. In optional embodiments, threaded members 88 may include screws or bolts. Threaded members 88 may be used to elevate a sink to the countertop. Generally speaking, once support rails 84 are in place, a user can place an undermounted sink above the support rails 84. By threading threaded members 88 through support rails 84, the threaded members 88 may extend out of the top surface of support rails 84. This will apply upward pressure on a sink positioned above the threaded members 88 and the support rails 84. In optional embodiments, threaded members 88 may also pass through one or more nuts 90. In optional embodiments, such nuts 90 may include T-nuts.

In year further optional embodiments, caps 92 may be positioned at one end of the threaded end. Generally, caps 92 may include indentation 94 to generally fit to the end of a threaded member 88. Caps 92 may contact the underside of the sink and preclude the twisting ends of threaded members 88 from contacting the underside of a sink. Optionally, caps 92 may have biting edges 98. Biting edges 88 are edges of cap 92 that are bent slightly upward to engage the underside of the sink. This may help preclude cap 92 from rotating with the rotations of its corresponding threaded member 88. Generally, the top surface of the indentation is below the top edges of the biting edges prior to installing the cap. In further optional embodiments one or more of the caps may include extended legs that extend at least partially down on each side surface of the support rail.

In yet further optional embodiments, support rails 84 may engage secondary support 96. Secondary support 96 may be above the top surface of support rail 84 and may be used to elevate a sink up against the underside of the countertop. Threaded members 88 may thread through support rails 84 and engage secondary supports 96. When threaded members 88 are rotated, they may further protrude from the top side of support rails 84 and engage secondary supports 96 and elevate secondary supports 96 relative to support rails 84. Otherwise stated, threaded members 88 may be used to push secondary supports 96 up against the underside of a sink and elevate it up to a countertop. In some optional embodiments, secondary supports 96 may be shorter in length than support rails 84. Also, secondary supports 96 may be formed from similar materials as support rails 84, though in some embodiments may be different. Generally, in optional embodiments, secondary supports 96 may be formed from wood.

In use with support rails 84, flexible support 14 may attach to each support rail 84. In arrangements of the system where the support rails extend from the back wall to the front of the cabinet (i.e. the door side), flexible support 14 attaches to a first support rail 84 on one side of the sink, goes underneath the sink and attaches to the other support rail 84. In optional embodiments, screws or the like may extend through flexible support holes 32 in connecting to connecting holes 86 on support rails 84. In optional embodiments, there may be different sizes of support rail holes 86, corresponding to connecting flexible support 14 or for the threaded members 88.

Generally, in installing an undermounted sink (either single bowl or double bowl) using the embodiment with support rails 84, a user may first optionally measure the width of the sink and calculate the positioning for support rails 84. After doing so, a user may then position anchors 12 in the appropriate position. Anchors 12 may be secured now or later, using any of the methods as described herein. In optional embodiments, a user may slightly pull on anchors 12 to make the portion with support hole 82 extend slightly away from the cabinet wall. A user may then position one support rail 84 between a set of two anchors 12. Generally, two support rails 84 and four anchors 12 may be used. A sink may then be placed upon support rails 84. A user may then rotate threaded members 88 (after optionally ensuring fit), and elevate a sink upward toward the underside of the countertop. In doing so, a user may have the ends of the threaded members 88 in contact with the underside of the sink, or may include caps 92 over the ends of the threaded members so that caps 92 may contact the underside of the sink. In further optional embodiments, secondary supports 96 may be used which contact the underside of a sink. Regardless, threaded members 88 may be rotated until the sink is elevated to the underside of the countertop. After, a user may attach flexible support 14 to one support rail 84, span beneath the sink bowl or bowls and attach flexible support 14 to the opposite support rail 84. Once tightened, the sink should be firmly positioned in place. In such embodiments, caulk or sealant could be utilized for sealing purposes, but one would in no way have to rely on the caulk or sealant for its adhesive properties in maintaining the sink in contact with the countertop.

The system according to the optional aspects of the invention may contain any type of anchor used with a flexible support for providing support to a sink which may be under mounted to a countertop. However, in its broadest aspect, the present invention could also be used to mount a variety of other sinks or at minimum provide support to top mounted sinks or the like.

Furthermore, sizes of various structural parts and materials used to make the above mentioned part or illustrative and exemplary only, and of ordinary skill in the art would recognize that these sizes and materials can be changed as necessary to produce different affects or desired characteristics.

It would become apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A system for mounting a sink under a countertop supported by at least two walls, the system comprising:
- two or more support rails, each support rail having a top surface, bottom surface and side surfaces;
- a plurality of holes through each support rail spanning from the top surface to the bottom surface;
- threaded members threaded through at least some of the plurality of holes spanning from the top surface to the bottom surface of each of the support rails;
- two or more secondary supports, each secondary support corresponding to a support rail and positioned above the top surface of the support rails; each secondary support also in engagement with the threaded members and elevatable above the corresponding support rail;
- two or more anchors, each anchor having:
  - a support hole configured to receive at least a portion of a support rail of the two or more support rails; and
  - mounting holes, each mounting hole configured to receive a fastener to mount the anchor to a respective wall of the at least two walls; and
- one or more sink bowl straps, each strap having ends with multiple holes for connecting to the support rails.

2. The system of claim 1 wherein one or more of the support rails comprise wood.

3. The system of claim 1 wherein one or more of the secondary supports comprise wood.

4. The system of claim 1 wherein one or more of the sink bowl straps comprise a metal strap.

5. The system of claim 1 wherein at least one of the secondary supports is shorter in length than the corresponding support rail.

6. The system of claim 1 further comprising two support rails and two secondary supports with each of the secondary supports shorter than each of the support rails.

7. The system of claim 1 wherein at least one of the anchors includes one or more stabilizing points.

8. The system of claim 1 wherein at least one of the anchors comprises:
- an angled portion for contacting the support rail, the angled portion free from contact with a respective wall of the at least two walls; and
- at least a first surface and a second surface for contacting the respective wall.

9. The system of claim 1 further comprising screws for attaching the strap to the support rails.

10. The system of claim 1 wherein at least two threaded members connect each support rail to its corresponding secondary support.

* * * * *